US010765929B2

(12) United States Patent
Jones et al.

(10) Patent No.: US 10,765,929 B2
(45) Date of Patent: Sep. 8, 2020

(54) RECONFIGURABLE PLAYING CARD DEVICES AND RELATED SYSTEMS AND METHODS

(71) Applicant: SG Gaming, Inc., Las Vegas, NV (US)

(72) Inventors: Steven Jones, Henderson, NV (US); Patrick Kyle Kornegay, Las Vegas, NV (US); Kurt Hilts, Stateline, NV (US)

(73) Assignee: SG Gaming, Inc., Las Vegas, NV (US)

( * ) Notice: Subject to any disclaimer, the term of this patent is extended or adjusted under 35 U.S.C. 154(b) by 0 days.

(21) Appl. No.: 15/893,953

(22) Filed: Feb. 12, 2018

(65) Prior Publication Data

US 2018/0161663 A1 Jun. 14, 2018

Related U.S. Application Data

(63) Continuation of application No. 14/539,897, filed on Nov. 12, 2014, now abandoned.

(60) Provisional application No. 61/903,191, filed on Nov. 12, 2013.

(51) Int. Cl.
*G07F 17/32* (2006.01)
*A63F 1/00* (2006.01)

(52) U.S. Cl.
CPC ..... *A63F 1/00* (2013.01); *G07F 17/322* (2013.01); *G07F 17/3211* (2013.01); *G07F 17/3293* (2013.01)

(58) Field of Classification Search
CPC .... A63F 1/02; A63F 9/24; A63F 13/00; A63F 2001/008; A63F 2009/2454; A63F 2009/241; G07F 17/32; G07F 17/322; G07F 17/3211
See application file for complete search history.

(56) References Cited

U.S. PATENT DOCUMENTS

| | | | |
|---|---|---|---|
| 4,900,903 | A | 2/1990 | Wright et al. |
| 5,823,873 | A | 10/1998 | Moody |
| 6,007,066 | A | 12/1999 | Moody |
| 6,098,985 | A | 8/2000 | Moody |
| 6,890,260 | B2 | 5/2005 | Ollins |
| 6,906,495 | B2 | 6/2005 | Cheng et al. |
| 6,906,496 | B1 | 6/2005 | Grace |
| 7,097,108 | B2 | 8/2006 | Zellner et al. |
| 7,189,161 | B1 | 3/2007 | Wiltshire et al. |
| 7,200,266 | B2 | 4/2007 | Ozer et al. |
| 7,438,992 | B2 | 10/2008 | Barker et al. |
| 7,458,825 | B2 | 12/2008 | Atsmon et al. |
| 7,552,467 | B2 | 6/2009 | Lindsay |
| 8,235,800 | B2 | 8/2012 | Gingher |
| 8,287,386 | B2 | 10/2012 | Miller et al. |
| 8,545,327 | B2 | 10/2013 | Miller et al. |
| 8,545,328 | B2 | 10/2013 | Miller et al. |
| 8,556,705 | B2 | 10/2013 | Gingher |

(Continued)

FOREIGN PATENT DOCUMENTS

WO 2014081406 A3 6/2015

*Primary Examiner* — William H McCulloch, Jr.
*Assistant Examiner* — Ankit B Doshi
(74) *Attorney, Agent, or Firm* — TraskBritt

(57) ABSTRACT

Reconfigurable gaming tables and playing cards, such as card devices including thin, planar display devices, may be in communication with a processing device for randomly selecting card images stored in a data storage device for display on the display devices.

19 Claims, 3 Drawing Sheets

(56) References Cited

U.S. PATENT DOCUMENTS

| | | | |
|---|---|---|---|
| 8,613,671 | B2 | 12/2013 | Miller et al. |
| 8,681,192 | B2 | 3/2014 | Inoue et al. |
| 8,766,593 | B2 | 7/2014 | Alberth |
| 8,771,078 | B2 | 7/2014 | Miller et al. |
| 8,773,350 | B2 | 7/2014 | Inoue et al. |
| 8,784,189 | B2 | 7/2014 | Miller et al. |
| 8,957,330 | B1 | 2/2015 | Knight |
| 9,046,926 | B2 | 6/2015 | Mohammed et al. |
| 9,054,668 | B2 | 6/2015 | Gorostegui |
| 9,058,056 | B2 | 6/2015 | Mohammed et al. |
| 9,256,286 | B2 | 2/2016 | Mohammed et al. |
| 9,489,856 | B2 | 11/2016 | Herz |
| 9,558,617 | B2 | 1/2017 | Peera |
| 9,609,267 | B2 | 3/2017 | Rapinat et al. |
| 2003/0048254 | A1 | 3/2003 | Huang |
| 2004/0248073 | A1 | 12/2004 | Pinkerman et al. |
| 2005/0184993 | A1 | 8/2005 | Ludwin et al. |
| 2005/0189139 | A1 | 9/2005 | Stole |
| 2006/0058088 | A1* | 3/2006 | Crawford, III ..... G07F 17/3227 463/13 |
| 2007/0111014 | A1 | 5/2007 | Katsoulis et al. |
| 2007/0191074 | A1 | 8/2007 | Harrist et al. |
| 2007/0191075 | A1 | 8/2007 | Greene et al. |
| 2007/0243456 | A1 | 10/2007 | Ahn et al. |
| 2007/0259716 | A1 | 11/2007 | Mattice et al. |
| 2007/0259717 | A1 | 11/2007 | Mattice et al. |
| 2007/0295327 | A1 | 12/2007 | Bottomley |
| 2008/0051043 | A1 | 2/2008 | Greene et al. |
| 2008/0063931 | A1 | 3/2008 | Zucker |
| 2008/0067247 | A1 | 3/2008 | McGregor et al. |
| 2008/0076505 | A1 | 3/2008 | Nguyen et al. |
| 2008/0076506 | A1 | 3/2008 | Nguyen et al. |
| 2008/0102957 | A1 | 5/2008 | Burman et al. |
| 2008/0113772 | A1 | 5/2008 | Burrill et al. |
| 2008/0169910 | A1 | 7/2008 | Greene et al. |
| 2008/0203903 | A1 | 8/2008 | De Kok et al. |
| 2008/0234024 | A1 | 9/2008 | Connors et al. |
| 2008/0246026 | A1 | 10/2008 | Kim |
| 2008/0252570 | A1 | 10/2008 | Kwon |
| 2008/0265754 | A1 | 10/2008 | Young et al. |
| 2008/0265759 | A1 | 10/2008 | Young et al. |
| 2008/0268934 | A1 | 10/2008 | Mattice et al. |
| 2008/0280682 | A1 | 11/2008 | Brunner et al. |
| 2008/0295327 | A1 | 12/2008 | Aeling et al. |
| 2008/0297448 | A1 | 12/2008 | Mizukoshi et al. |
| 2008/0303782 | A1 | 12/2008 | Grant et al. |
| 2008/0309867 | A1 | 12/2008 | Kampstra |
| 2009/0001380 | A1 | 1/2009 | Yang et al. |
| 2009/0009396 | A1 | 1/2009 | Yang |
| 2009/0009496 | A1 | 1/2009 | Kwak et al. |
| 2009/0058361 | A1 | 3/2009 | John |
| 2009/0087024 | A1 | 4/2009 | Eaton et al. |
| 2009/0093300 | A1 | 4/2009 | Lutnick et al. |
| 2009/0103161 | A1 | 4/2009 | Kothari et al. |
| 2010/0311488 | A1 | 12/2010 | Miller et al. |
| 2010/0311489 | A1 | 12/2010 | Miller et al. |
| 2010/0311490 | A1 | 12/2010 | Miller et al. |
| 2010/0311493 | A1 | 12/2010 | Miller et al. |
| 2010/0311494 | A1 | 12/2010 | Miller et al. |
| 2010/0311502 | A1 | 12/2010 | Miller et al. |
| 2010/0312625 | A1 | 12/2010 | Miller et al. |
| 2011/0124397 | A1 | 5/2011 | Gingher |
| 2012/0040753 | A1 | 2/2012 | Hsiao et al. |
| 2012/0182677 | A1 | 7/2012 | Seo |
| 2012/0188292 | A1 | 7/2012 | Inoue et al. |
| 2013/0014198 | A1 | 1/2013 | Rapinat et al. |
| 2013/0316321 | A1 | 11/2013 | Herz |
| 2014/0167938 | A1 | 6/2014 | Mohammed et al. |
| 2015/0145849 | A1 | 5/2015 | Choi et al. |
| 2015/0209654 | A1 | 7/2015 | Jones et al. |
| 2016/0093159 | A1 | 3/2016 | Racz et al. |

* cited by examiner

RECONFIGURABLE PLAYING CARD DEVICES AND RELATED SYSTEMS AND METHODS

CROSS-REFERENCE TO RELATED APPLICATIONS

This application is a continuation of U.S. patent application Ser. No. 14/539,897, filed Nov. 12, 2014, which claims the benefit of U.S. Provisional Patent Application No. 61/903,191, which was filed Nov. 12, 2013, the disclosure of each of which is incorporated herein by reference.

BACKGROUND

The disclosure generally relates to systems and methods for facilitating the play of wagering games.

Wagering games, such as baccarat, blackjack and various poker-based table games are popular games offered in casinos. These games are generally played on physical gaming tables having felt layouts and require a steady supply of playing cards, which are then randomly shuffled and dealt during the game.

While it appears that players generally prefer physical playing cards over the presentation of virtual cards displayed on a display device, the use of playing cards and associated equipment, such as card shoes, shufflers and handling systems with card reading devices, represents a significant expense. In addition to purchasing, storing and replacing cards, card shoes and shuffling devices, operators must also employ various methods and systems to ensure the integrity of games in which cards are used. A significant amount of time and effort is spent by casino personnel in connection with the use of playing cards in wagering games.

The felt table surfaces are also problematic in that they wear out and must be replaced. Felt surfaces are also limited in that they are game specific.

Thus, there is a need in the art for systems and methods that resolve the aforementioned issues relating to the use of playing cards in gaming without negatively impacting player interest in playing games that traditionally involve playing cards.

BRIEF SUMMARY

The disclosure relates generally to a card-shaped device (hereinafter referred to as a card or card device), system and method, which resolves the aforementioned issues in the art, among other things.

Some embodiments of the disclosure are directed to a reconfigurable playing card device, comprising a display device having a peripheral edge and first and second opposing planar sides; and a support frame enclosing the peripheral edges of the display device, wherein the first display side is exposed, the support frame including a processing device, a data storage device and a communication device embedded therein, wherein at least one of the first and second sides are configured to display card images.

In some embodiments of the reconfigurable playing card device the display device comprises a flexible LCD.

In some embodiments of the reconfigurable playing card device the support frame encloses the second side of the display device.

In some embodiments of the reconfigurable playing card device the card images are randomly selected from the data storage device by the processing device.

In some embodiments of the reconfigurable playing card device the card images are randomly selected by a remote processing device from a remote data storage device.

In some embodiments of the reconfigurable playing card device the cards are detected by the data communication device and the processing device determines the outcome of games.

In some embodiments of the reconfigurable playing card device the cards are detected by the data communication device and the remote processing device determines the outcome of games.

In some embodiments of the reconfigurable playing card device the card images are detected and used to determine the outcome of games.

Some embodiments of the disclosure are directed to a reconfigurable playing card device, comprising: a first display device and a second display device, each of the first and second display devices having a peripheral edge and first and second opposing sides; and a support frame contacting the peripheral edge of each of the first display device and second display device and supporting the first and second display devices in a mounted position wherein the second sides of the first and second display devices are adjacent to one another, and the first sides of the first and second display devices are exposed and mounted in a position facing away from one another, wherein the support frame further includes a processing device configured to randomly select face images of playing cards stored in a data storage device, and a communication device, all embedded therein, wherein one or both of the first and second sides of the display devices are configured to display card images.

In some embodiments of the reconfigurable playing card device the first and second display devices comprise a flexible LCD.

In some embodiments of the reconfigurable playing card device the support frame encloses the peripheral edge of the first and second display devices.

In some embodiments of the reconfigurable playing card device the cards are detected by the data communication device and the processing device determines the outcome of games.

In some embodiments of the reconfigurable playing card device the cards are detected by the data communication device and the remote processing device determines the outcome of games.

In some embodiments of the reconfigurable playing card device at least one of the first planar sides of the first and second display devices is touch-enabled.

In some embodiments of the reconfigurable playing card device a plurality of card images is randomly selected for display.

Some embodiments of the disclosure are directed to a reconfigurable playing card device, comprising: a first display device and a second display device, each of the first and second display devices having a peripheral edge and first and second opposing sides; and a support frame contacting the peripheral edge of each of the first display device and second display device and supporting the first and second display devices in a mounted position wherein the second sides of the first and second display devices are adjacent to one another, and the first sides of the first and second display devices are exposed and mounted in a position facing away from one another, wherein the support frame further includes a processing device, a data storage device, and a communication device, all embedded therein, wherein one or both of the first and second sides of each of the display devices are configured to display card images.

In some embodiments of the reconfigurable playing card device the first and second display devices comprise a flexible LCD.

In some embodiments of the reconfigurable playing card device the support frame encloses the peripheral edge of the first and second display devices.

In some embodiments of the reconfigurable playing card device the cards are detected by the data communication device and the processing device determines the outcome of games.

In some embodiments of the reconfigurable playing card device the cards are detected by the data communication device and the remote processing device determines the outcome of games.

In some embodiments of the reconfigurable playing card device a plurality of card images are randomly selected for display.

In some embodiments a plurality of card images are randomly selected for display on one or both of the first and/or second display devices.

BRIEF DESCRIPTION OF THE DRAWINGS

Certain embodiments of the disclosure are disclosed with reference to the following drawings.

DETAILED DESCRIPTION

In the following detailed description, reference is made to the accompanying drawings, which form a part of this application. The drawings provide and illustrate specific exemplary embodiments in which the disclosure may be practiced. It will nevertheless be understood that no limitation of the scope of the embodiments of the disclosure is thereby intended. Any alterations and further modifications of the inventive feature illustrated herein, and any additional applications of the principles of the embodiments of the disclosure as illustrated herein, which would normally occur to one skilled in the relevant art and having possession of this disclosure, are to be considered within the scope of the disclosure as claimed. It is also to be understood that other embodiments may be utilized and structural changes may be made without departing from the scope of the disclosure.

Figure 1:
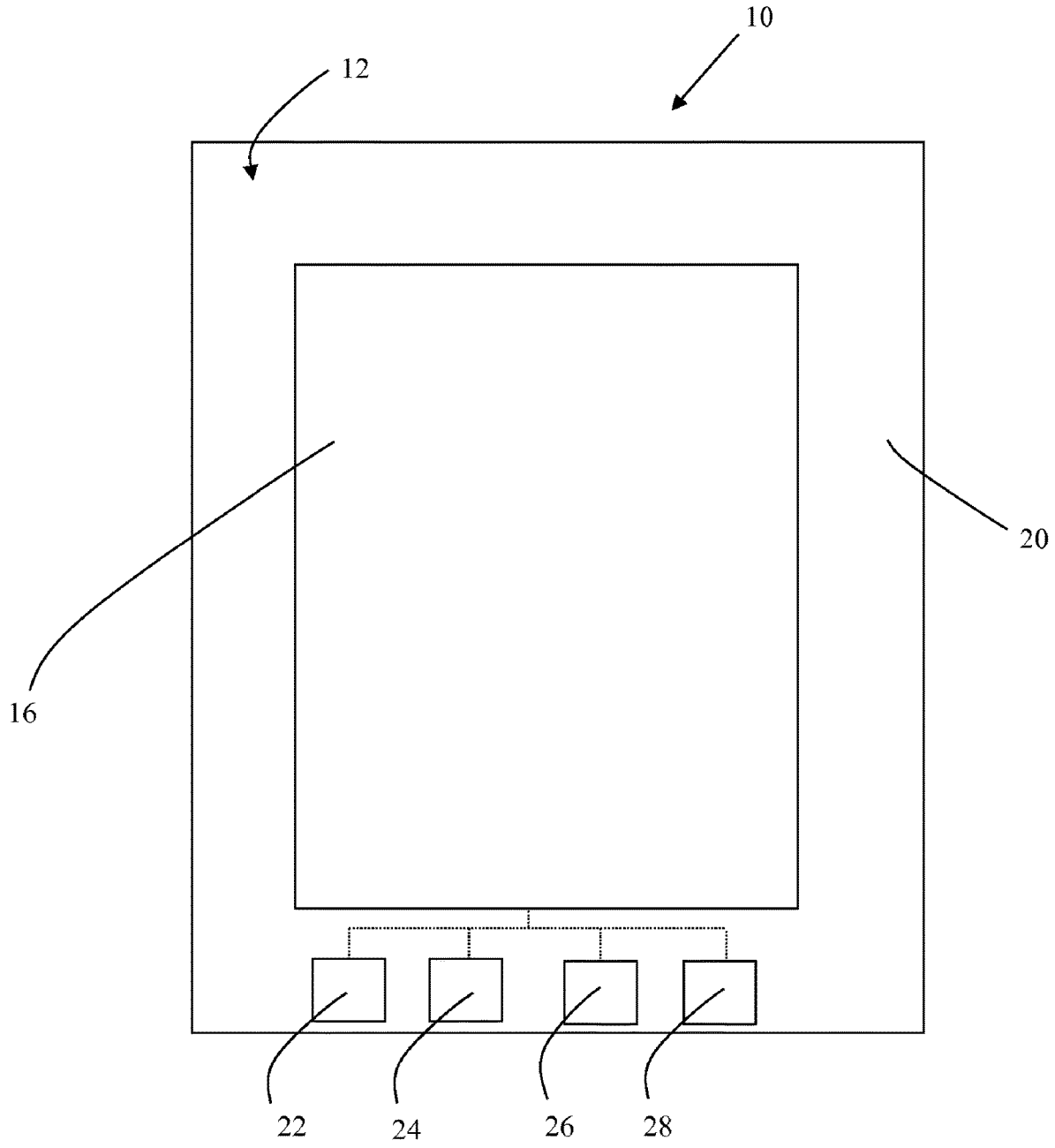
FIG. 1 illustrates a front view of an exemplary card constructed according to some embodiments of the disclosure.
Figure 2:
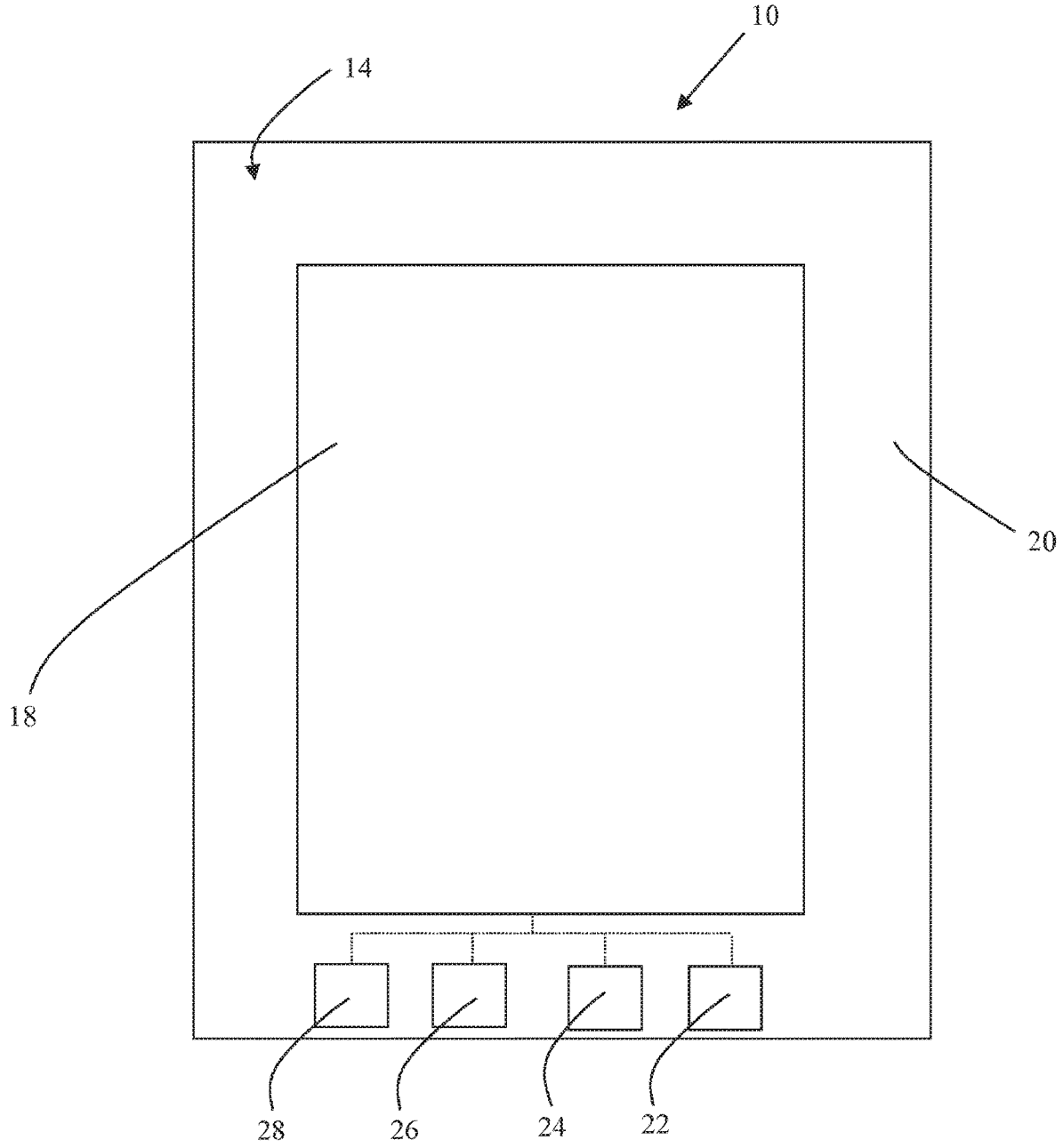
FIG. 2 illustrates a rear view of an exemplary card constructed according to some embodiments of the disclosure.

FIGS. 1 and 2 illustrate an exemplary embodiment of a reconfigurable playing card of the disclosure which is generally referred to as card 10. Card 10 includes opposing sides 12 and 14, each side 12 and 14 including a display device 16 and 18, respectively, mounted in an outer support frame 20 such that support frame 20 contacts and encloses the peripheral edges of each display device 16 and 18. Display devices 16 and 18, and support frame 20 are constructed out of a resilient yet flexible material. For example, support frame 20 may be constructed of a plastic, rubber or rubberized material while display devices 16 and 18 may be formed of a thin layer of flexible LCD screens or glass, such as a commercially available flexible glass product like CORNING® WILLOW® Glass.

A power source 22, data processing device 24, memory or data storage device 26, wireless communication device 28 is also shown as embedded in support frame 20 and in communication with one another and display devices 16 and 18 to support the functionality of displaying card images on one or both sides 12 and 14 in connection with the play of a wagering game.

When using cards 10 to play a game, a plurality of cards is dealt to player positions at a gaming table. Upon being dealt, communication device 28 communicates with data processing device 24 and data storage device 26 or another control or processing device and data storage device (not shown), which may be included at a gaming table or card shoe configured to hold a plurality of cards 10, in order to determine the number of cards 10 dealt and corresponding number of images, that is, card faces having suit and rank, to randomly select for each card 10. In some embodiments, the cards 10 dealt are linked and programmed to select images for all cards from the same group of images that represent one or more decks of cards or sets of symbols. In other embodiments, each card 10 is configured to randomly select a card image from its onboard data storage device 26 which contains a group of images that may represent one or more decks of cards or symbols, including text. It should be understood that more than one card may be displayed on one or both of the display devices 16 and 18 of card 10.

Communication device 28 receives symbols or card images and other information, depending on the game, which is displayed on display devices 16 and 18. The card images received may be provided and directed to a plurality of cards 10 according to a random selection process such that the plurality of cards 10 function effectively as if one or more randomized decks of cards had been dealt. In some embodiments, display device 16 is the default front side or face of card 10 whereas display device 18 is the default back of the card. In some embodiments, there is no display device 18 and the back of the card is opaque.

Display device 18 may be opaque or present other designs or images, such as the casino trademark, should the usage of card 10 require temporarily hiding the card image, that is, so the card 10 appears as if it is in a "face down" condition. Card 10 may be configured by, for example, communication with a local computerized source, to show the hidden image on the face down display device 16 side on the display device 18 at the back of card 10, without flipping over the card. In other words, a card image from display device 16 can be shown on display device 18 when a trigger condition is detected, such as when revealing the dealer's second card in blackjack.

Once the wagers are resolved, a signal is received by communication device 28 resulting in the removal of the card image from the display devices 16 and 18, which can be replaced by game results or other non-card images. Should another game not be started, cards 10 may be deactivated. The signal received by communication device 28 may come from the onboard processing device 24 or another processing device operatively associated with a communication device.

In some embodiments, cards 10 are configured such that each card 10 detects being dealt or dispensed from a card shoe and transmits a request via communication device 28 to receive a randomized card value for display from a local source, such as a computer in the table, nearby or in the shoe, which can be limited to communicate to only a certain group of cards 10. Alternatively, the request may be sent to the onboard data processing device 24 to retrieve a card image from data storage 26.

Regardless of the manner in which the card images are revealed on display devices 16 and 18, the images are known before the outcome of the game which may be used to automate the determination of the game outcome and delivery of a prize, which may be a payout or credit, for example, and compare with game play data to ensure the integrity and security of the game. Cards 10 can be configured to detect the presence and proximity of other cards 10, which may be uniquely identifiable by another card 10. A controller or onboard processing device 24 may then determine the cards 10 in each player position and with the card image information, be able to determine the outcome of game play for each player over each round of a game.

Display devices 16 and 18 may also be touch-enabled devices to facilitate greater interactivity between the player and other players, the dealer and the casino operator, or to allow the player to take actions in the game according to the rules. For example, a player may tap on the display device 16 or 18 to discard the card and be dealt a new card. In this example, card 10 would not be discarded but rather a card image displayed would change and be replaced by a randomly selected card image. Players may also access personal information, game play rules and advice.

Figure 3:
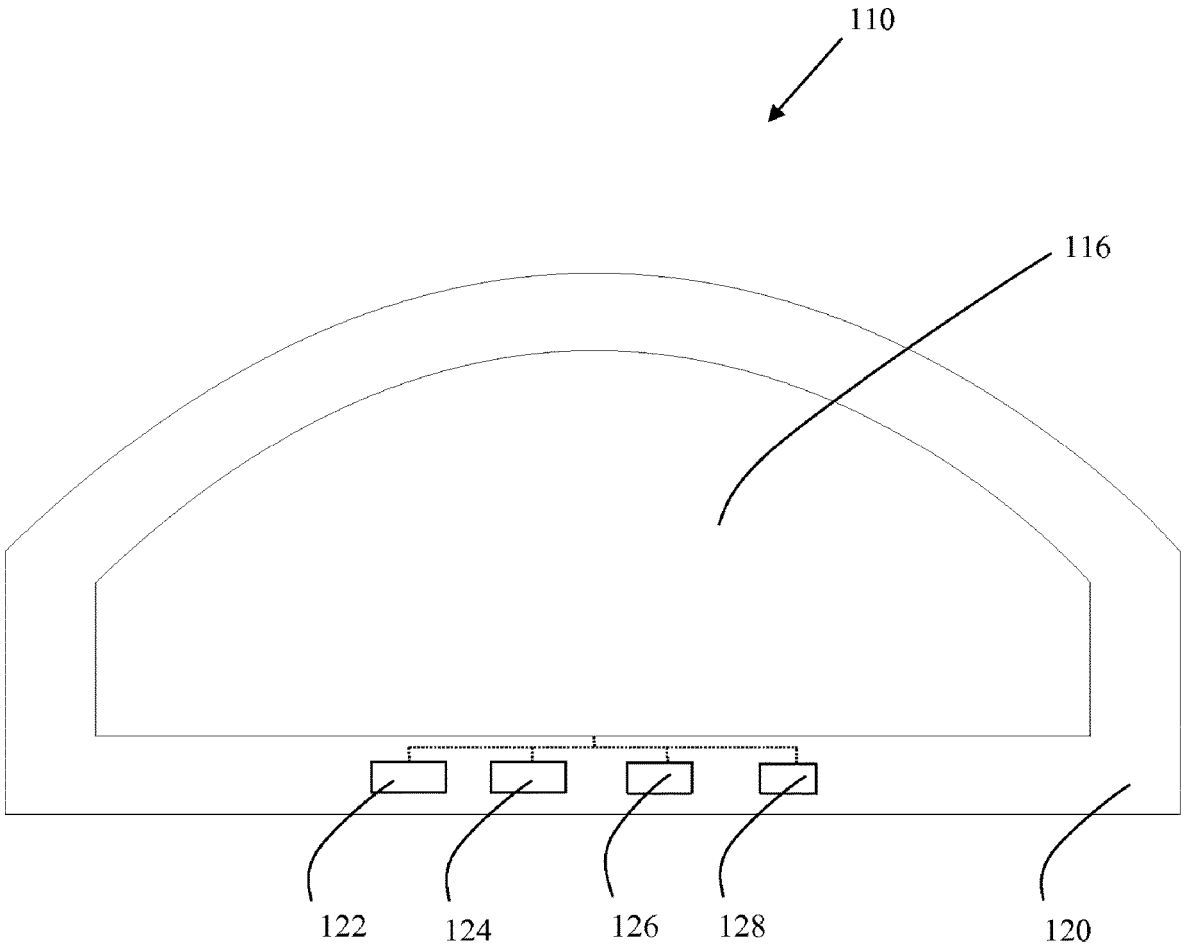
FIG. 3 illustrates a top view of an exemplary gaming table constructed according to some embodiments of the disclosure.

FIG. 3 illustrates an exemplary gaming table 110 having a display device surface made of the same or a similar material as used for display devices 16 and 18. Gaming table 110 includes a display device or reconfigurable surface 116 supported by support structure 120. Surface 116 is in communication with various components shown schematically as being mounted in support structure 120 but which may communicate with surface 116 from remote locations. Surface 116 may provide an interface for selecting a game to be played thereon. If surface 116 is touch-enabled, then the selections may be inputted directly on surface 116. Surface 116 provides table surface displays that may include player positions such as those provided by traditional felt table surfaces, according to the game selected. Surface 116 can be changed to provide different layouts for different casinos and different table games, with associated wagering options, paytable information and provide for different numbers of player positions.

Game play information and images may be accessed from storage in data storage device 126 and executed via data processing device 124 for display on surface 116 through communication device 128. Thus, card images are displayed at player positions on surface 116 and may be animated to appear as being dealt from a dealer position to the player position. Representations of wagers may also be shown on surface 116. Gaming table 110 may obtain credit data from player input, such as through a swipe card or through identification of the player at the table and link via communication device 128 with an electronic account. Players may input selections, such as wagers or cards to discard, or otherwise indicate preferences in the game. Processing device 124 randomly selects card images which are then displayed on surface 116 in the game.

It should be understood that methods and systems such as those described herein may be adapted and configured to function independently, or may also interact with other systems or applications, such as, for example, a casino management system, bonusing system or player tracking system. It should be understood that the advantages of the disclosure discussed herein comprise only some of the advantages of the disclosure, and the disclosure is not to be limited in any way by such advantages.

A processor, processing device, controller, computing device, or computer, such as described herein, includes at least one or more processors or processing units and a system memory. The controller typically also includes at least some form of computer-readable media and for the embodiments discussed above, includes or is in communication with a random number generator, which may comprise a software program. By way of example and not limitation, computer-readable media may include computer-storage media and communication media. Computer-storage media may include volatile and nonvolatile, removable and non-removable media implemented in any method or technology that enables storage of information, such as computer-readable instructions, data structures, program modules, or other data. Communication media typically embody computer-readable instructions, data structures, program modules, or other data in a modulated data signal such as a carrier wave or other transport mechanism and include any information delivery media. Those skilled in the art should be familiar with the modulated data signal, which has one or more of its characteristics set or changed in such a manner as to encode information in the signal. Combinations of any of the above are also included within the scope of computer-readable media.

The order of execution or performance of the operations in the embodiments of the disclosure illustrated and described herein is not essential, unless otherwise specified. That is, the operations described herein may be performed in any order, unless otherwise specified, and embodiments of the disclosure may include additional or fewer operations than those disclosed herein. For example, it is contemplated that executing or performing a particular operation before, contemporaneously with, or after another operation is within the scope of aspects of the disclosure.

In some embodiments, a processor, as described herein, includes any programmable system including systems and microcontrollers, reduced instruction set circuits (RISC), application specific integrated circuits (ASIC), programmable logic circuits (PLC), and any other circuit or processor capable of executing the functions described herein. The above examples are exemplary only, and thus are not intended to limit in any way the definition and/or meaning of the term processor.

In some embodiments, a database, as described herein, includes any collection of data including hierarchical databases, relational databases, flat file databases, object-relational databases, object oriented databases, and any other structured collection of records or data that is stored in a computer system. The above examples are exemplary only, and thus are not intended to limit in any way the definition and/or meaning of the term database.

This written description uses examples to disclose the disclosure, including the best mode, and also to enable any person skilled in the art to practice the disclosure, including making and using any devices or systems and performing any incorporated methods. Certain aspects which would be known to those skilled in the art have been omitted so as not to distract from the elements and features of the disclosure. The patentable scope of the disclosure is defined by the claims, and may include other examples that occur to those skilled in the art. Other aspects and features of the disclosure can be obtained from a study of the drawings, the disclosure, and the appended claims. The disclosure may be practiced otherwise than as specifically described within the scope of the appended claims. It should also be noted, that the steps and/or functions listed within the appended claims, notwithstanding the order of which steps and/or functions are listed therein, are not limited to any specific order of operation.

Those skilled in the art will readily appreciate that the gaming table, card and card shoe of the disclosure may include various computer and network related software and hardware, such as programs, operating systems, memory storage devices, data input/output devices, data processors, servers with links to data communication systems, wireless or otherwise, and data transceiving terminals, and may be a standalone device, incorporated in the card or shoe or another platform, such as a gaming table. Those skilled in the art will further appreciate that the precise types of software and hardware used are not vital to the full implementation of the system and methods of the disclosure.

While exemplary systems and methods, and applications of methods of the disclosure, have been described herein, it should also be understood that the foregoing is only illustrative of a few particular embodiments with exemplary and/or preferred features, as well as principles of the disclosure, and that various modifications can be made by those skilled in the art without departing from the scope of the disclosure. Therefore, the described embodiments should not be considered as limiting of the scope of the disclosure in any way. Accordingly, the disclosure embraces alternatives, modifications and variations which fall within the spirit and scope of the disclosure as set forth in the claims and equivalents thereto.

What is claimed is:

1. A method of providing at least one reconfigurable playing card device, the method comprising:

providing the at least one reconfigurable playing card device to at least one player at a live wagering game at a gaming table with a dealer, the at least one reconfigurable playing card device comprising a support frame enclosing an entirety of peripheral edges and at least a portion of a back side of a display, the support frame including a processing device, a data storage device, and a communication device positioned at least partially within the support frame at a location laterally at least partially beyond the peripheral edges of the display between the peripheral edges of the display and an outside edge of the support frame; and displaying images of playing cards on a front side of the display of the at least one reconfigurable playing card device at the gaming table, the front side opposing the back side of the display.

2. The method of claim 1, further comprising displaying the images of the playing cards only on the front side of the display while the support frame entirely encloses the back side of the display.

3. The method of claim 1, further comprising providing a flexible display comprising a flexible LCD screen and providing a flexible frame, both configured to be elastically deformed.

4. The method of claim 1, further comprising randomly selecting the images of the playing cards displayed on the at least one reconfigurable playing card device with the processing device from the data storage device.

5. The method of claim 1, further comprising randomly selecting the images of the playing cards displayed on the at least one reconfigurable playing card device with a remote processing device from a remote data storage device.

6. The method of claim 1, further comprising detecting the images of the playing cards.

7. The method of claim 6, further comprising determining an outcome of at least one card game based on the detection of the images of the playing cards with the processing device.

8. The method of claim 6, further comprising determining an outcome of at least one card game based on the detection of the images of the playing cards with a remote processing device.

9. The method of claim 1, further comprising enabling the at least one player to input selections to the at least one reconfigurable playing card device with a touch screen.

10. The method of claim 1, further comprising:

displaying an image of at least one playing card of the playing cards in an initially obscured manner; and removing the obscured manner of the image of the at least one playing card of the playing cards and displaying the image of the at least one playing card of the playing cards unobstructed when a trigger condition based on play of a wagering game is detected.

11. A method of providing at least one reconfigurable playing card device, the method comprising:

providing the at least one reconfigurable playing card device to at least one player at a wagering game at a gaming table in a casino, the at least one reconfigurable playing card device comprising a support frame enclosing an entirety of a periphery of a front side of a display and an entirety of a back side of the display, the front side opposing the back side of the display, the support frame including an electronics assembly positioned between the display and the support frame; and displaying images of playing cards on the front side of the display of the at least one reconfigurable playing card device, wherein providing the at least one reconfigurable playing card device comprises supplying the at least one reconfigurable playing card device including the support frame having the electronics assembly including at least one of a processing device, a data storage device, or a communication device positioned at least partially within the support frame at a location laterally, along a major plane of the display, between peripheral edges of the display and an outside edge of the support frame.

12. The method of claim 11, further comprising enabling the at least one player to input selections into the at least one reconfigurable playing card device with the display comprising a touch screen.

13. The method of claim 11, further comprising:

detecting the images of the playing cards with the at least one reconfigurable playing card device; and determining an outcome of at least one card game based on the detection of the images of the playing cards.

14. A system for providing a reconfigurable playing card device at a gaming table in a casino, comprising:

at least one playing card device comprising a support frame enclosing an entirety of a periphery of a front side of a display;

a data storage device configured for storing images of playing cards; and a processing device operably coupled to the data storage device and configured for randomly displaying the images of the playing cards on the front side of the display of the at least one playing card device, wherein the data storage device and the processing device are located in the support frame at least partially laterally outside of the periphery of the display between the periphery of the front side of the display and an outer edge of the support frame.

15. The system of claim 14, wherein the support frame encloses the processing device and the data storage device within the support frame at a location laterally between the periphery of the front side of the display and the outer edge of the support frame.

16. The system of claim 14, wherein the support frame encloses an entirety of a back side of the display, the back side opposing the front side of the display.

17. The system of claim 14, wherein the support frame encloses a back side of the display, the processing device, and the data storage device within the support frame.

18. The system of claim 14, wherein the processing device is further configured for determining an outcome of at least one card game based on the displayed images of the playing cards.

19. The system of claim 14, wherein both the display and the support frame are configured to be elastically deformed.

* * * * *